United States Patent [19]

Miniaci et al.

[11] 4,277,902

[45] Jul. 14, 1981

[54] BAGGAGE IDENTIFICATION TAG

[75] Inventors: Salvatore J. Miniaci, Bronx; James O. Christiansen, Massapequa Park, both of N.Y.

[73] Assignee: Avery International Corporation, San Marino, Calif.

[21] Appl. No.: 4,942

[22] Filed: Jan. 19, 1979

[51] Int. Cl.[3] ..... A44C 3/00

[52] U.S. Cl. ..... 40/2 R

[58] Field of Search ..... 40/2, 21 R, 20, 2 R, 40/21 C, 21; 283/6, 18, 21; 229/92.1, 92.3, 74

[56] References Cited

U.S. PATENT DOCUMENTS

| | | | |
|---|---|---|---|
| 1,247,628 | 11/1917 | Britton | 40/2 R X |
| 2,987,840 | 6/1961 | Marshall | 40/2 R |
| 3,352,040 | 11/1967 | Javkin | 40/21 R |
| 3,808,718 | 5/1974 | Christiansen | 40/21 R |
| 3,994,085 | 11/1976 | Groseiak | 40/21 R |
| 4,112,603 | 9/1978 | Giulie | 40/21 R |

FOREIGN PATENT DOCUMENTS

| | | | |
|---|---|---|---|
| 2266242 | 3/1974 | France | 40/21 C |
| 144096 | 6/1920 | United Kingdom | 40/2 R |

*Primary Examiner*—Gene Mancene
*Assistant Examiner*—Wenceslao J. Contreras
*Attorney, Agent, or Firm*—Christie, Parker & Hale

[57] ABSTRACT

A baggage identification tag has printed indicia indicating passenger identification data to be provided in write-in spaces on the tag with first and second margins being left on opposite sides of the printed indicia. A double adhesive strip is secured to one of the margins for providing an adhesive layer facing away from the tag, and a fold line is formed across and printed indicia. Passenger indentification data provided in the printed area of the tag can be sealed inside the tag by folding the tag along the fold line and adhesively securing one margin of the tag to the adhesive layer on the other margin. A string extending through an eyelet-reinforced opening in one of the margins can be used to releasably fasten the tag, with the sealed passenger identification information, to an article such as a piece of luggage. A slit in the margin of the tag adjacent the printed area prevents delamination of the tag in the printed area when the tag is unsealed.

17 Claims, 3 Drawing Figures

BAGGAGE IDENTIFICATION TAG

BACKGROUND OF THE INVENTION

This invention relates to baggage identification tags.

Government regulations have required that the outside of all baggage be identified with the passenger's name and address. The purpose is to identify the owner of the baggage if the baggage is lost. The airlines also benefit from such identification because the number of lost baggage claims can be greatly reduced.

A present method of using pressure sensitive labels with the passenger's name and address is undesirable because such labels can cause damage to expensive luggage. Many travelers refrain from using such labels or other identification tags that expose their name and address for fear of alerting professional burglars that a home will be unoccupied while the owner is traveling.

The present invention provides a baggage identification tag which allows a passenger to write his name and address on the tag and to seal this information inside the tag so his name and address are not exposed. The baggage identification tag of this invention can be manufactured at a reasonably low cost, so that airlines can reasonably afford to put the tag in all of their terminals and travel agencies. These advantages of the baggage identification tag can encourage use by a greater number of passengers, thereby reducing lost luggage and resulting lost baggage claims.

SUMMARY OF THE INVENTION

Briefly, the baggage identification tag of this invention includes a substrate with opposite first and second faces, and visual indicia on a first face of the substrate base for indicating identification data to be provided on the first face of the substrate. First and second margins are left on opposite sides of the visual indicia, and adhesive means on the first margin face away from the first face of the substrate base. Means are provided to facilitate folding of the substrate so the second margin contacts the adhesive means on the first margin for sealing the visual indicia inside the folded substrate. Thus, passenger identification data can be provided on the side of the tag having the visual indicia, and the tag can be folded and secured by the adhesive means so the passenger identification data is not exposed.

The tag can include means for inhibiting adhesive delamination of the first face of the substrate in the portion of the substrate containing the visual indicia when the adhesive means is unsealed from the second margin of the substrate.

These and other aspects of the invention will be more fully understood by referring to the following detailed description and the accompanying drawing.

DRAWING

DETAILED DESCRIPTION

Figure 1:
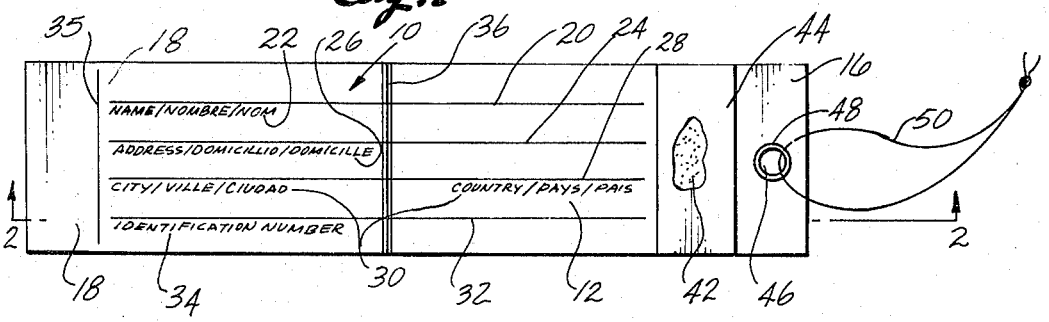
FIG. 1 is a top plan view showing a baggage identification tag according to this invention.
Figure 2:
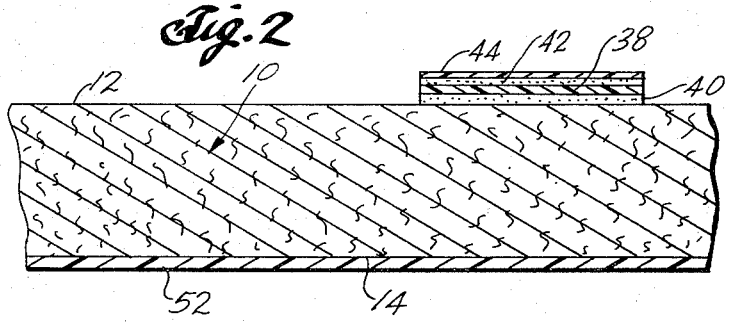
FIG. 2 is a fragmentary schematic cross-sectional view exaggerated in size and taken along the line 2—2 of FIG. 1.

Referring to the drawing, a baggage identification tag includes a thin foldable, rectangular substrate 10. In the preferred embodiment, the substrate base is made of paperboard, preferably of 18 point thickness. The substrate has a flat first face 12 shown in FIG. 1 and an opposite flat second face 14 shown in FIG. 3.

The first face of the substrate has a first margin 16 extending adjacent one short edge of the substrate, and a second margin 18 extending adjacent an opposite short edge of the substrate. The first margin is approximately twice as wide as the second margin.

Visual indicia are printed on the first face of the substrate between the first and second margins. The visual indicia indicate identification data to be provided in write-in spaces on the first face of the substrate. In the illustrated embodiment, the visual indicia are in the form of a first line 20 and printed characters 22 identifying a first space in which a passenger's name is to be written, a second line 24 and printed characters 26 identifying a second space in which a passenger's address is to be written, a third line 28 and printed characters 30 identifying a third space in which a passenger's city and country of residence is to be written, and a fourth line 32 and printed characters 34 identifying a fourth space in which a passenger identification number or the like is to be written. The substrate is thus formed from a material such as paperboard capable of receiving written information from conventional writing instruments such as a pen or pencil. The substrate material also is capable of receiving typewritten information.

A score line or fold line 36 extends approximately along the midpoint of the region in which the visual indicia are provided. In the illustrated embodiment, the score line 36 extends across the entire width of the substrate in a direction parallel to the short edges of the substrate.

A score line 35 is die cut along the second margin 18 of the tag adjacent the visual indicia. The score line is a thin, straight cut extending for nearly the entire width of the tag, terminating just short of the top and bottom edges of the tag. The slit is preferably cut immediately outboard of the region where the visual indicia are printed, i.e., in a margin of the tag where passenger identification data is not likely to be written.

A first adhesive layer is provided on the first margin of the substrate, i.e., opposite the margin where the the slit 35 is located. The adhesive layer and the score line 36 are arranged so that the substrate can be folded along the score line to enable the substrate base to be folded essentially in half, with the second margin 18 being able to overlap the adhesive layer on the first margin 16. In the illustrated embodiment, the adhesive layer is formed by a strip 38 of double adhesive tape extending across the short dimension of the substrate generally parallel to the score line and the opposite short edges of the substrate. A first layer 40 of adhesive on one side of the tape 38 secures the tape to the first face of the substrate. A second adhesive layer 42 on the opposite side of the tape faces upwardly away from the first face of the substrate. A flexible removable backing strip 44 is releasably secured over the upwardly facing second adhesive layer 42 for providing a protective backing until the identification tag is used.

The adhesive strip is spaced inwardly from the adjacent short edge of the substrate to provide a marginal region for a circular aperture 46 extending through the substrate. A circular eyelet 48 reinforces the periphery of the aperture.

A flexible elongated string 50, preferably in the form of a loop, extends through the aperture 46. In one embodiment, the string is an elastically stretchable string that facilitates extending the tag through a loop formed by the string releasably securing the tag to a piece of luggage.

Visual indicia 51 can be printed on the second face of the substrate for identifying the airline or other company supplying the baggage identification tag. The second face of the substrate is preferably coated with a thin protective layer 52. In one embodiment, the protective layer comprises a one mil thick layer of polyester.

In using the baggage identification tag, the passenger first writes his or her name, address, city, country and any identification number in the spaces provided on the first face of the substrate. The protective backing 44 of the adhesive layer is then removed to expose the second layer of adhesive 42, and the substrate is folded in half along the fold line 36 so the second margin 18 of the substrate overlies the second layer of adhesive 42 on the first margin 16. The second margin 18 is then pressed firmly against the exposed second layer of adhesive to seal the written identification information inside the folded tag. This leaves the protectively-coated second face of the tag exposed, displaying the name of the airline, for example, while the passenger identification information remains protected from view inside the folded tag. The tag is then releasably secured to a piece of luggage by the string 50. Should the baggage become lost or otherwise require identification, the substrate can be pealed away from the adhesive layer without harming the written information inside the tag so that the owner of the baggage can be identified.

Figure 3:
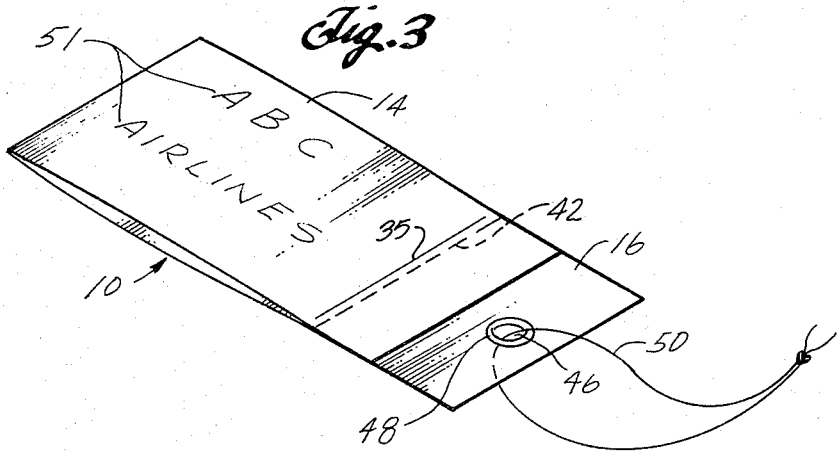
FIG. 3 is a perspective view showing a folded position of the baggage identification tag.

When the second layer of adhesive 42 overlies and is secured to the second margin 18 of the tag, the slit 35 is located close to the inner edge of the second adhesive layer, as illustrated in FIG. 3. Preferably, folding of the tag along the score line 36 automatically positions the second margin over the second adhesive layer, with the slit being spaced away from the adhesive, as illustrated. The slit prevents delamination of the tag, and consequent destruction of information written in the printed areas of the tag. The adhesive used in adhesive layer 42 can be quite tacky, in order to provide adhesive bonding in a variety of climatic conditions in which the tag is used. If the tag needs to be unsealed to expose the passenger information written on the tag, such a tacky adhesive can cause the paper tag to delaminate across at least a portion of the region where the information is written, and possibly destroy the information. The slit allows the tag to delaminate only across the second margin up to where the slit is located, i.e., the slit can prevent delamination in a horizontal direction from one side of the slit to the other. Thus the slit can preserve the information written inside the tage when the tag is unsealed.

What is claimed is:

1. A baggage identification tag comprising:

a paper-like substrate having a first face and an opposite second face;

visual indicia on the first face of the paper-like substrate adjacent a write-in space of said first face having a surface capable of receiving hand-written information from a pencil or pen, such visual indicia including words that indicate passenger name and address information is to be written in said write-in space;

the first face of the substrate having first and second margins on opposite sides of the visual indicia and said write-in space;

adhesive means on the first margin facing away from the first face of the substrate; and a score line extending across the paper-like substrate between the first and second margins for facilitating folding of the substrate so the second margin contacts the adhesive means on the first margin for obscuring and sealing the visual indicia and the hand-written information provided in said write-in space, inside the folded substrate, the adhesive means permitting the folded substrate to be unsealed for exposing said visual indicia and the hand-written information.

2. The baggage identification tag according to claim 1 wherein the adhesive means comprises a strip having a first adhesive layer on one side securing the strip to the first margin of the substrate, and the second adhesive layer on an opposite side of the strip facing away from the first face of the substrate.

3. The baggage identification tag according to claim 1 including an aperture adjacent at least one of said margins.

4. The baggage identification tag according to claim 5 including an eyelet reinforcing the aperture.

5. The baggage identification tag according to claim 3 including a string extending through the aperture for use in securing the tag to an article.

6. The baggage identification tag according to claim 1 including means in the first margin of the substrate on a side of the adhesive means opposite the visual indicia for use in securing the tag to an article.

7. The baggage identification tag according to claim 6 in which said means for securing the tag to an article includes an aperture, an eyelet reinforcing the aperture, and a string extending through the aperture for use in securing the tag to an article.

8. The baggage identification tag according to claim 7 including a protective layer on the second face of the substrate.

9. The baggage identification tag according to claim 1 including means on the second margin for inhibiting adhesive delamination of the first face of the substrate said write-in space of the substrate, where the visual indicia are located, when the adhesive means is unsealed from the second margin of the substrate.

10. The baggage identification tag according to claim 9 in which the means for inhibiting delamination comprises a slit in the substrate adjacent the visual indicia.

11. The baggage identification according to claim 10 in which the slit is located on the substrate so that folding of the substrate along the fold line causes the slit to overlap a portion of the substrate spaced from the adhesive layer.

12. A baggage identification tag comprising:

a substrate having a first face and an opposite second face;

visual indicia on the first face of the substrate for indicating identification data to be provided on said first face of the substrate;

the first face of the substrate having first and second margins on opposite sides of the visual indicia;

adhesive means on the first margin facing away from the first face of the substrate;

means facilitating folding of the substrate so the second margin contacts the adhesive means on the first margin for obscuring and sealing the visual indicia inside the folded substrate; and means on the second margin for inhibiting adhesive delamination of the first face of the substrate in the portion of the substrate where the visual indicia are located when the adhesive means is unsealed from the second margin of the substrate.

13. The baggage identification tag according to claim 12 in which the means for inhibiting delamination comprises a slit in the substrate adjacent the visual indicia.

14. The baggage identification tag according to claim 13 in which the slit is located on the substrate so that folding of the substrate causes the slit to overlap a portion of the substrate spaced from the adhesive layer.

15. The baggage identification tag according to claim 14 in which the substrate comprises a paper-like material.

16. The baggage identification tag according to claim 12 including means in the first margin of the substrate on a side of the adhesive means opposite the visual indicia for use in securing the tag to an article.

17. The baggage identification tag according to claim 12 in which the substrate comprises a paper-like material.

* * * * *

UNITED STATES PATENT AND TRADEMARK OFFICE

CERTIFICATE OF CORRECTION

PATENT NO. : 4,277,902

DATED : July 14, 1981

INVENTOR(S) : S.J. Miniaci and James O. Christiansen

It is certified that error appears in the above—identified patent and that said Letters Patent is hereby corrected as shown below:

In the specification, Column 2, Line 1, "18 point thickness" should read -- 18-point thickness --; Line 44, delete fourth occurrence of "the". Column 3, Line 53, "tage" should read -- tag --. In the claims, Column 4, Line 40, Claim 9, after "substrate" insert -- in --; Line 48, Claim 11, insert -- tag -- after "identification --.

Signed and Sealed this

*Second* Day of *February 1982*

[SEAL]

*Attest:*

GERALD J. MOSSINGHOFF

*Attesting Officer*

*Commissioner of Patents and Trademarks*